United States Patent [19]

May et al.

[11] Patent Number: 4,465,749

[45] Date of Patent: Aug. 14, 1984

[54] ELECTROSTATIC CHARGE DIFFERENTIAL AMPLIFICATION (CDA) IN IMAGING PROCESS

[75] Inventors: John W. May, Rochester; Yee S. Ng, Fairport, both of N.Y.

[73] Assignee: Eastman Kodak Company, Rochester, N.Y.

[21] Appl. No.: 506,256

[22] Filed: Jun. 20, 1983

[51] Int. Cl.[3] ..... G03G 13/00

[52] U.S. Cl. ..... 430/54; 430/52; 430/120; 430/97

[58] Field of Search ..... 430/97, 117, 120, 54

[56] References Cited

U.S. PATENT DOCUMENTS

| | | | |
|---|---|---|---|
| 2,756,676 | 7/1956 | Steinhilper | 430/126 |
| 3,888,664 | 6/1975 | Carlson et al. | 430/126 |
| 3,918,971 | 11/1975 | Zweig | 355/3 DD X |
| 3,981,727 | 9/1976 | Nelson et al. | 430/54 |
| 4,063,946 | 12/1977 | Tamaii et al. | 430/46 |
| 4,175,958 | 11/1979 | Naganuma et al. | 430/49 |
| 4,256,820 | 3/1981 | Landa | 430/54 |
| 4,278,884 | 7/1981 | Landa | 250/315.2 |

FOREIGN PATENT DOCUMENTS 57-46262 3/1982 Japan .

*Primary Examiner*—John D. Welsh
*Attorney, Agent, or Firm*—Torger N. Dahl

[57] ABSTRACT

A method for amplifying an electrostatic, charge-differential pattern is disclosed. The method comprises (a) imagewise forming a first toner deposit by developing a first electrostatic pattern having a first charge differential per unit area whose maximum value is no greater than a preselected level, (b) in an image-amplification element comprising a charge-holding surface layer overlying a field-supporting electrode, forming a current-carrying path between the toner deposit and the field-supporting electrode, (c) under conditions in which nontoned regions are not photoexcited, overall charging the image-amplification element with sufficient charge to form an enhanced electrostatic charge pattern having a second charge differential per unit area whose maximum value is greater than the preselected value in step (a), and (d) developing the enhanced charge pattern into a second toner deposit. By this process, high-maximum-density, continuous-tone images can be produced wherein the maximum density of such images is obtained by amplification of initial charge differentials whose maximum value is, for example, 30 nanocoulombs/cm$^2$ or lower. In addition, images can be produced with low contrast, i.e., obtained over a wide exposure range.

13 Claims, 7 Drawing Figures

ELECTROSTATIC CHARGE DIFFERENTIAL AMPLIFICATION (CDA) IN IMAGING PROCESS

The present invention relates to electrostatography, and more particularly to a method of amplifying an electrostatic image formed with low energy input.

Imaging systems based on silver halide technology have for some time occupied a superior position in photography because they offer high degrees of gain, or amplification, relative to small amounts of imaging light. For example, photographic films and papers having speeds of ISO 25-1000 and higher are commercially available.

In electrostatography, electrostatic image signals are developed with an electrostatic developer composition. These signals are made up of a pattern of differential electrostatic charge (in units of nanocoulombs/cm$^2$), that is, spatial regions which have a net electrostatic charge per unit area different from that of adjacent regions. The various methods by which the electrostatic pattern is formed include, among others, photoconductive imaging and dielectric recording. The former is based on imagewise exposure of a charged photoreceptor to light. In dielectric recording, the electrostatic image is formed on a charge-holding layer by imagewise contact with a charged stylus or other suitable means. In either case, the differential charge of the pattern so formed is reduced (neutralized) by development with the developer composition, producing an imagewise deposit of toner.

Unfortunately, the amplification directly associated with electrostatographic systems is significantly lower than that of silver halide systems. For example, in order to reproduce on a photoreceptor areas of a subject which have maximum density (Dmax), the photoreceptor should have a charge differential per unit area roughly equal to at least about 60 nanocoulombs/cm$^2$ and, in most systems, 100 nanocoulombs/cm$^2$ or greater. (The precise charge differential depends on a number of factors such as the developer sensitivity and completeness of development.) In order to achieve such differentials,, and hence such image densities, high levels of light exposure are required, at least an order of magnitude greater than the corresponding amount of light required for silver halide systems.

In electrographic imaging systems, the charge differential requirement for Dmax reproduction is similar to that for photoconductive systems except that the differential is not brought about by exposure to light. (ISO ratings are, therefore, not applicable.) However, the energy necessary to create charge differentials of 60-100 nanocoulombs/cm$^2$ or greater in one step can be considerable. In some applications, such energy is initially unavailable or difficult to provide, in which case images with inadequate Dmax seem inevitable.

It is apparent that electrostatographic systems have to be capable of producing maximum image densities from charge patterns having charge differentials per unit area of much lower initial magnitude in order to be considered as viable alternatives to conventional silver halide imaging. To this end, techniques are reported in the prior art for signal amplification of low initial charge differentials. U.S. Pat. No. 4,256,820 issued Mar. 17, 1981, to B. Landa, for example, describes the formation of a faint toner image in early stages of the process. The toned regions in the image serve as an optical mask during a later-stage overall light exposure of the charged photoreceptor to prevent the toned regions from discharging during the later stage. After the later-stage exposure, the photoreceptor is redeveloped. Similarly, U.S. Pat. No. 3,981,727 issued Sept. 21, 1976, to A. C. Nelson describes a multistep xeroradiographic process involving a low-dosage, first-stage toner image which is amplified by later-stage recharging and overall photoexcitation. These methods of amplification depend upon photoexcitation of the photoconductor to enhance the charge differential per unit area during low-exposure image acquisition. Unfortunately, the first toner images in both methods require significant optical density to provide adequate images in the later stages. It will be appreciated that the higher such density requirements are, the lower the amplification will be overall. Furthermore, in processes where a toner is employed as a mask for later photoexcitation, the image contrast is quite high by comparison with processes in which imaging involves only a single charging and exposure step.

The present invention provides a method of amplifying an electrostatic charge differential pattern comprising the following steps:

(a) imagewise forming a first toner deposit by developing a first electrostatic charge pattern having a first charge differential per unit area whose maximum value is not greater than a preselected level, preferably no more than 30 nanocoulombs/cm$^2$, (b) in an image-amplification element comprising a charge-holding surface layer overlying a field-supporting electrode, forming a current-carrying path between the first toner deposit and the field-supporting electrode, (c) under conditions in which nontoned regions of the charge-holding layer are not photoexcited, overall charging the image-amplification element with sufficient charge to form an enhanced electrostatic charge pattern having a second charge differential per unit area whose maximum value is greater than the preselected level in step (a), and (d) developing the enhanced charge pattern into a second toner deposit.

THE DRAWINGS

In connection with the description below, reference will be made to the accompanying drawings in which.

DETAILED DESCRIPTION OF PREFERRED EMBODIMENTS

Figure 1:
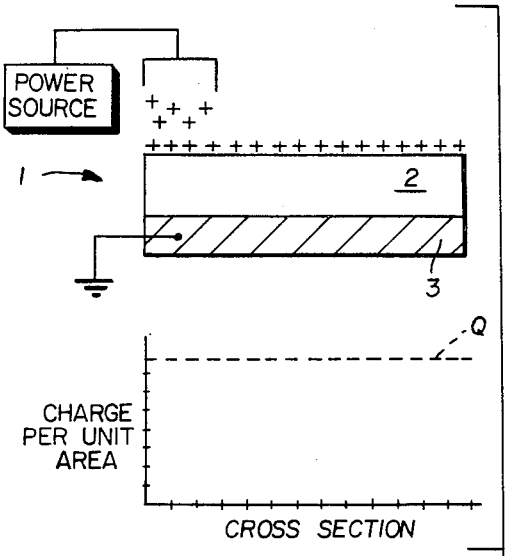
FIG. 1 represents an electrostatically charged photoreceptor and a profile of the charge across the surface of the photoreceptor.

The present invention provides a unique way of amplifying a charge differential per unit area from a low level—i.e., a level not useful to produce images of useful maximum density (Dmax) as presently understood in the field of electrostatography—to a high level which can be employed to form images of high Dmax. In addition, images resulting from the practice of the present invention can be lower in contrast (i.e., have a wider exposure latitude) compared with methods involving single-charging, high level of exposure and development. To this end, the invention embodies the idea of forming a current-carrying path between a low-density toner imagewise deposit and an electric-field-supporting electrode, along which path current can be carried imagewise to form a high charge differential per unit area, e.g., a charge differential of 60–150 nanocoulombs/cm$^2$ or greater.

For convenience, the method to be detailed will be referred to by the initials "CDA", for Charge Differential Amplification. In the initial step of the method, a toner deposit is imagewise formed by development of a first electrostatic charge pattern. The charge pattern is formed corresponding to a desired image under conditions so as to have a charge differential per unit area whose maximum value is no greater than a preselected level. The preselected value is preferably 30 nanocoulombs/cm$^2$, and the maximum value of the charge differential per unit area is preferably from about 5 nanocoulombs/cm$^2$ to about 15 nanocoulombs/cm$^2$. The charge pattern can be formed by photoconduction (in which case a photoreceptor is employed), by dielectric recording (which employs a charge-holding element) or other charge-forming means.

In the formation of the first electrostatic charge pattern by photoconduction, a photoreceptor is uniformly charged and thereafter imagewise exposed to actinic radiation. The maximum amount of actinic radiation employed is low in comparison with exposures ordinarily employed in electrophotography; e.g., it is sufficient to dissipate no more than 30 nanocoulombs/cm$^2$ of charge in light-struck regions. Alternatively, charge-pattern formation can be by dielectric recording, in which case a charge differential pattern on a dielectric recording element is created by a charged stylus or by other suitable means. The differential amount of charge per unit area applied is no more than, for example, 30 nanocoulombs/cm$^2$.

After the first charge pattern is formed, it is imagewise developed with an electrostatic developer composition containing toner materials to form a first toner deposit. The developer employed, however, must be one which forms a current-carrying path with a field-supporting electrode described in greater detail below. Negative or positive first toner deposits (referring to the image sense of the toner deposit) can be formed in this step depending on the polarity of charge on the toner in the developer and of the polarity of the charge in the electrostatic charge pattern. Development can be aided and controlled by means of a bias voltage applied across the development zone according to methods well-known in the art.

The developers employed can be of the single- or two-component dry type, or of the liquid type in which the toner particles are suspended in an electrically insulating liquid.

Representative developer compositions which can be employed to form a current-carrying path include the cross-linked toner compositions disclosed in the examples of Jadwin U.S. Pat. No. 3,938,992 issued Feb. 17, 1976; the wax-containing developer compositions described in the examples of Alexandrovich European Patent Application No. 62,482 published Oct. 13, 1982; the polyester plasticized tonercontaining developers described in copending Alexandrovich U.S. patent application Ser. No. 448,885 filed Nov. 19, 1982; and any of the toner compositions described in Santilli U.S. Pat. No. 4,052,325 issued Oct. 4, 1977. These compositions preferably contain a conductive pigment such as carbon black, cuprous iodide, palladium, copper, transition metal oxides such as iron oxide, quinacridones or aluminumphthalocyanines such as hydroxy- and chloroaluminumphthalocyanine, dispersed throughout a polymeric binder in each toner particle or one or more compounds which are used in the art as chargecontrol agents such as quaternary ammonium salt compounds as disclosed in U.S. Pat. Nos. 3,893,935 and 4,323,634, and polyoxyethylene palmitate, cobalt naphthenate and zinc resinate, as disclosed in *Research Disclosure,* Item 10938, May, 1973, published by Industrial Opportunities Ltd., Homewell, Havant, Hampshire, PO 9 1EF, UK. It is not necessary, however, that the first toner deposit exhibit optical density. Accordingly, colorants are optional.

Simultaneous with, or subsequent to its formation, the first toner deposit is brought into contact with the surface of an image-amplification (IA) element comprising a charge-holding surface layer overlying a field-supporting electrode, within which element a current-carrying path between the first toner deposit and the field-supporting electrode is formed. It will be appreciated that the photoconductive or dielectric recording element employed in the toner deposit-formation step and the IA element can be the same or different elements. In photoconductive and dielectric elements, the outermost layers, or course, are charge-holding layers which overlie field-supporting electrode layers, commonly referred to as electrically conducting layers.

Several embodiments are contemplated herein for forming the first toner deposit and bringing it into contact with the IA element where the current-carrying path is formed. In one embodiment, the first electrostatic charge pattern can be formed on a photoconductive or dielectric recording element, transferred to an IA element and developed on the latter with an appropriate developer. Alternatively, the first charge pattern can be developed on the photoconductive or dielectric recording element and the resulting first toner deposit transferred to the IA element. In a third, preferred embodiment, the formations of the first toner deposit and of a current-carrying path are practiced on a single element.

The charge-holding layer on the IA element can be composed of any one of a variety of known compositions employed in the electrostatographic field capable of accepting and holding a surface electrostatic charge. Representative photoconductive compositions and elements include the homogeneous arylalkane photoconductive compositions described in U.S. Pat. No. 4,301,226 issued Nov. 17, 1981, to L. E. Contois et al; aggregate photoconductive compositions described in U.S. Pat. Nos. 3,615,414 issued Oct. 26, 1971, to W. A. Light and 3,973,962 issued Aug. 10, 1976, to L. E. Contois et al; and multiactive photoconductive elements having an underlying aggregate photoconductive charge-generating layer and an overlying photoconductive, charge-transporting layer as described in U.S. Pat. No. 4,175,960 issued Nov. 27, 1979, to M. A. Berwick et al.

The field-supporting electrode under the charge-holding layer can be an integral, electrically conducting layer or substrate, or a separate electrode in electrical communication with the charge-holding layer. Useful electrodes include conductive paper supports, metals such as nickel vapor-deposited on a support, cuprous iodide-containing layers, and any other electrically conducting material having a suitably low resistivity. Representative electrode materials are described in the above *Research Disclosure,* Item 10938.

Current-Carrying Path

A significant aspect of the present invention comprises the formation of a current-carrying path in the IA element between the first toner deposit and the field-supporting electrode. By "current-carrying path" we mean one capable of dissipating charge so that, when the first toner deposit has been charged by, say, a corona-charging device, the charge will dissipate via the current-carrying path from the toned areas. Conversely, the nontoned, background regions of the charge-holding surface layer element will block the applied charge, thus leading to charge differentials of virtually any practical magnitude desired, the key to providing useful Dmax when charged and toned a second time in the CDA process.

A variety of current-carrying paths are contemplated in the CDA process. We will elaborate on a few of these but other means are also applicable.

In selecting suitable materials to provide current-carrying ability, one must consider as a system the type of toner in the first deposit, the type of charge-holding layer of the IA element, and the means by which the two are adhered. While some general statements can be made as to classes of materials which are useful, their utility usually depends on the type of materials employed as the other system components.

Two types of current-carrying paths are presently preferred: (1) current paths formed as a result of a lowering of the electrical resistance between the first toner deposit and the field-supporting electrode and (2) current paths formed within the element by the toner, charge-holding layer and field-supporting electrode wherein the toner, when electrostatically charged, is capable of injecting charge carriers into the charge-holding layer while the latter transports the carrier toward the electrode.

Direct contact between the first toner deposit and the field-supporting electrode can lower the electrical resistance between the toner and electrode. Alternatively, the first toner deposit can contain a material which migrates imagewise into the charge-holding layer so as to render the layer conductive where the migrated material has left a path. The migratory material may be a conductive material or a chemical which produces conductivity by imagewise chemical reaction within the layer. The first toner deposit, moreover, can be activated to release the migratory material in a variety of ways such as by treatment with a solvent which can permeate the dielectric layer and carry with it the conductive material, or the charge-holding layer on the IA element can be heated to promote the necessary migration.

A charge-injection type of current-carrying path can also be formed, wherein a charge carrier is injected from one material into a charge-transporting material and the injected carrier transported toward a field-supporting electrode. In this embodiment of the CDA process, the toner, charge-holding surface layer, and means by which the toner is adhered to the charge-holding layer are selected so as to create a charge-injection type of current-carrying path. For example, the toner can comprise a charge-injection material such as a carbon-black-pigmented, thermoplastic resin toner, and the charge-holding layer can comprise, for example, a photoconductive layer which will transport carriers injected into it when not photoexcited.

The determination of whether charge can be injected from one material into another is empirical. We have found, however, that glass transition temperature, Tg, may be significant. Thus, the glass-transition temperature, Tg, of our toner is preferably less that that of the charge-holding layer. Also, in the case where pigmented toner deposits are employed containing microcrystals of pigment in a large volume fraction of unpigmented binder polymer, direct physical contact of pigment crystals with the charge-holding layer through the unpigmented binder polymer may also be desirable to facilitate charge injections.

In adhering the first toner deposit to the charge-holding layer, we prefer to fuse the two such as by heat, pressure or self-fixing means, thereby improving the intimacy of contact between the two which appears to affect the rate of charge injection.

In selecting potentially useful materials to form a current-carrying path, off-line evaluations can be conducted to determine the ability of the first toner and charge-holding layer to sustain a current path to a field-supporting electrode. Such path preferably transports charge so as to form charge differentials per unit area whose maximum value is at least 60 nanocoulombs/cm$^2$, preferably from about 100 to about 150 nanocoulombs/cm$^2$. Furthermore, the rate of charge transport via the current-carrying path must also be greater than the unexcited decay rate (i.e., dark decay) of the charge-holding-layer surface in nontoned regions. Otherwise, while a current-carrying path may be formed, as defined, image discrimination will be lost as a result in the background areas' inability to hold a later-applied charge as described below.

In sum, therefore, any IA element whose charge-holding layer can be modified by an appropriate toner to form current-carrying capability toward the electrode in toned regions is potentially useful in the present method.

In the second stage of CDA, the IA element carrying the first toner deposit is recharged so that both background and toner-deposit regions thereon receive a uniformly applied charge. The conditions of such recharging, moreover, are such that the untoned regions of the charge-holding layer are not photoexcited, thereby excluding photogenerated charge carriers in the untoned regions. Accordingly, if the charge-holding layer is not photoconductive (i.e., a dielectric material), recharging can proceed in daylight or room light. If the charge-holding layer is photoconductive, however, recharging must take place either in the dark or under safelight conditions so as not to cause photodischarge in the background of the charge-holding layer. When the recharging is completed to a sufficient level, as measured in the background (i.e., nontoned) regions, charge will dissipate imagewise through the current-carrying path formed on the IA element, thus creating an enhanced charge pattern having a second charge differential per unit area between background and first toner-deposit regions. The time required to form the enhanced charge pattern is short, usually on the order of 1–5 seconds, after which the charge levels in the toned and background regions remain relatively stable. The magnitude of the second charge differential, which is greater than that of the charge differential per unit area in the first charge pattern, is limited only by the amount of charge applied in the second stage. Typically, the maximum charge differential per unit area in the second charge pattern is 60 nanocoulombs/cm$^2$ and greater, and preferably is from about 100 to about 150 nanocoulombs/cm$^2$.

The second charge pattern is developed into a second toner deposit with any suitable electrostatic developer composition which may be the same as or different from the developer employed to form the first toner deposit. Thus, a second toner deposit is formed having high Dmax by a process in which the initial, image acquisition charge differentials are low.

Referring to the drawings, the invention will be illustrated by means of a single element approach wherein the image-charging, developing and fixing steps in both the first and amplification stages of the CDA process are practiced on a single photoconductive element. In these figures, negative-positive imaging is practiced referring to the image sense; that is, toner density is produced on the copy corresponding to areas on the original without density. Accordingly, FIG. 1 represents a photoconductive element 1 which is positively charged on the surface of its photoconductive layer 2 overlying an electrically conducting layer 3, which is grounded. From the graph in FIG. 1, the charge per unit area across the entire photoconductive layer 2 is observed to be uniform at a level of $Q_1$ charge units per unit area.

After charging, photoconductor 1 is imagewise exposed through an original 4 having opaque regions 5 and transparent regions 6. In this step, the imaging light 7 is typically of very low intensity or duration, so as to form a resulting differential charge pattern (or charge profile) on the photoconductive layer as shown by the graph in FIG. 2. While the charge differential per unit area, $Q_1-Q_2$, can be any value desired, the process is preferably practiced so as to produce a $Q_1-Q_2$ differential of no greater than 30 nanocoulombs/cm$^2$.

Figure 2:
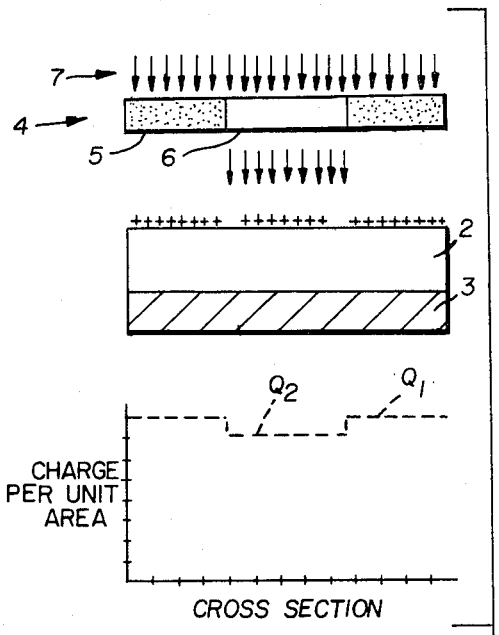
FIG. 2 represents an imagewise exposure of the photoreceptor in FIG. 1 and the resulting charge profile across the surface of the photoreceptor.
Figure 3:
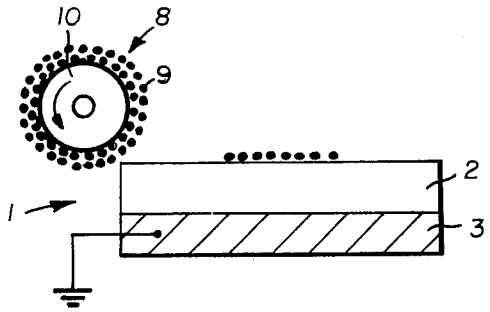
FIG. 3 represents the development of the photoreceptor in FIG. 2.

The positive-polarity pattern on the element in FIG. 2 is then developed (FIG. 3) with developer means 8 comprising an applicator and a supply of positively charged electrostatic developer 9. When the developer 9 is brought into contact with the charge pattern, a faintly visible toner deposit 11 can be formed in light-struck regions of the charge pattern corresponding to the $Q_2$ levels of charge shown in the graph of FIG. 2. It will be appreciated, of course, that the toner deposit can also be formed in the non-light-struck regions of the photoconductive layer 2 by use of a negatively charged developer.

The developer composition 9 depicted by the drawings is selected so that the toner deposit 11 forms a current-carrying path between it and the conducting layer 3 when the toner deposit is heat-fixed to photoconductive layer 2. Useful materials for the developer and the photoconductive element layers are set forth in the examples below.

Figure 4:
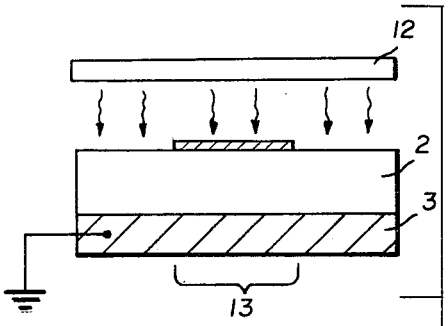
FIG. 4 represents heat-fixing of the developed photoreceptor of FIG. 3.

When the toner deposit 11 is in place on the element, it is heat-fixed (FIG. 4) by exposure to heat-fixing means 12, thus forming the requisite current-carrying path between the fixed toner deposit 11 and the conductive layer 3 in region 13 of the element.

Figure 5:
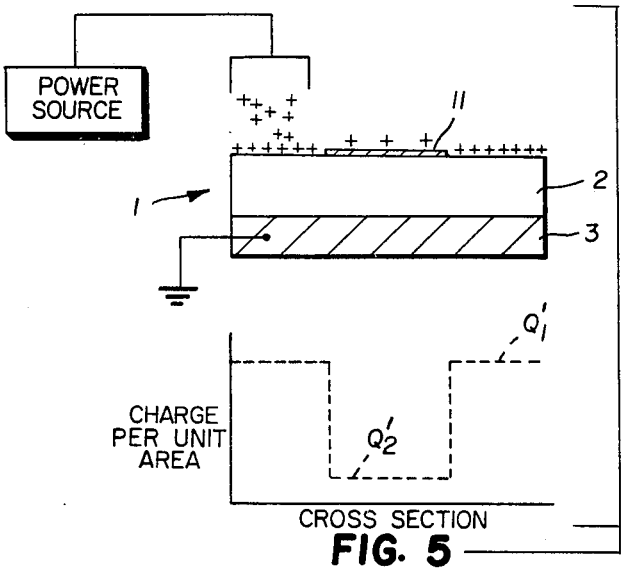
FIG. 5 represents the photoreceptor of FIG. 4, after having been electrostatically recharged, and the resulting charge profile across the photoreceptor.
Figure 6:
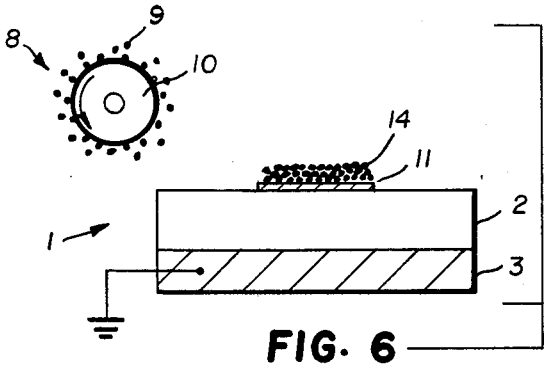
FIG. 6 represents the photoreceptor in FIG. 5 after having been redeveloped.
Figure 7:
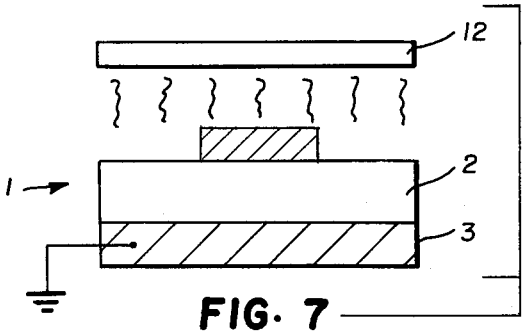
FIG. 7 represents heat-fixing of the redeveloped image in FIG. 6.

The element carrying the fixed toner deposit 11 is thereafter overall electrostatically recharged to a positive polarity (FIG. 5) so as to produce a charge profile across the element as depicted by the graph in FIG. 5. The recharging step is conducted under conditions in which the background regions (i.e., the regions to either side of the toner deposit) are nonphotoexcited. When recharged, the fused toner deposit 11 is unable to hold the applied charge as a consequence of the current-carrying path established in the earlier steps. Hence, an enhanced differential charge per unit area, $Q_2-Q_1$, is formed on the element which is greater than the charge differential per unit area formed as a consequence of the imaging step depicted in FIG. 2, although no light is employed in forming the enhanced differential charge pattern. Finally, when the enhanced differential charge pattern is redeveloped with a positively charged developer (FIG. 6), an additional toner deposit 14 forms on the fused toner deposit 11, but in a greater quantity, thereby forming an image with higher maximum density. The additional toner deposit 14 can then be optionally heat-fixed (FIG. 7) to form the desired amplified, low-contrast image. Alternatively (not shown), the additional toner deposit 14 can be transferred to another element, while the element bearing the fused first deposit 11 is used for xeroprinting by repeating the recharge, redevelop and transfer steps.

The process described herein represents a unique, all-electrostatic method of amplifying electrostatic signals and has many applications; for example, one can now extend the useful range of many photoreceptors. If the photoreceptor ordinarily requires high dye levels for spectral sensitization, the dye levels can now be significantly decreased without loss in speed. Or, the photoreceptor can be employed in spectral regions such as the ultraviolet, infrared or X-ray regions where it previously was considered to be insufficiently sensitive for use. Furthermore, CDA can be employed with photoreceptors having low field dependence. Such photoreceptors produce low charge differentials from low initial voltages, Vo. While the lower Vo is desirable, the low charge differentials have heretofore been difficult to develop into useful images.

The following examples are included to aid in the practice of the invention. In these examples, voltages were measured and converted to charge per unit area by the equation:

$$Q=cv$$

where

Q=charge/unit area in nanocoulombs/cm$^2$;

c=total capacitance per unit area of the charge-holding layer and any other layers overlying the field-supporting electrode, in nanofarads/cm$^2$;

v=potential on the charge-holding layer in volts.

Amplification is also reported in the examples as the gain in speed of the CDA process over the corresponding control speed point. The speed point for negative-positive (neg-pos) image-sense examples was 0.1 density unit above the background density (which is defined as the density of the element in untoned regions plus fog density). Speedpoints for positive-positive (pos-pos) image-sense examples, on the other hand, were determined in accordance with Section 4 of American National Standard Institute, Inc. (ANSI), procedure PH 2.21-1979. (The speedpoint in ANSI PH 2.21-1979 is characterized as Hm, the sensitometric parameter from which speed is measured.)

EXAMPLE 1

This example illustrates charge differential amplification in a negative-positive image-sense mode of development on a photoconductive element wherein a charge-injection type of current-carrying path is formed between a first toner deposit and a field-supporting electrode through the photoconductive layer.

The image-amplification element employed was a photoconductive element comprising a polyester film support, a cuprous iodide field-supporting electrode layer on the support, a cellulose nitrate barrier layer on the electrode layer and a photoconductive layer overlying the barrier layer. The photoconductive layer comprised a ternary mixture of leuco base arylalkane photoconductor compounds and an arylamine compound in a polyester matrix. The photoconductor layer is disclosed in Example 7 of U.S. Pat. No. 4,301,226 issued Nov. 17, 1981, to L. E. Contois, the disclosure of which is incorporated herein by reference. The photoconductive layer was approximately 8 micrometers in thickness and the barrier layer was 2 micrometers in thickness.

The photoconductive layer of the element was charged uniformly to an initial charge density of 180 nanocoulombs/cm$^2$ (+600 volts). The charged layer was imagewise-exposed to light with about 19 relative exposure units to lower the charge density in regions struck with maximum light by 12 nanocoulombs/cm$^2$. (This corresponded to a voltage differential between such regions and unexposed regions of approximately 40 volts.)

The resulting first electrostatic charge pattern was developed in the dark with a positively charged liquid electrographic developer of the type described in the examples of Alexandrovich European Patent Application No. 62,482 published Oct. 13, 1982, at a development electrode bias of +570 volts. This developer had a developer sensitivity of 12 OD cm$^2$/$\mu$C, in terms of the optical density, OD, which it would produce from a unit of charge density, in microcoulombs ($\mu$C) per cm$^2$, and contained a thermoplastic resin pigmented with carbon black as the toner constituent. The thermoplastic resin was poly[neopentyl-4-methylcyclohexene-1,2-dicarboxylate-coterephthalate-co-5-(N-potassio-p-toluenesulfonamidosulfonyl)isophthalate)] 50/45/5. The developer also contained the quaternary ammonium salt copolymer poly[vinyl toluene-co-lauryl methacrylate-co-beta(methacryloxy)ethyl trimethyl ammonium p-toluenesulfonate] as a charge-control agent. The resulting first toner deposit had a maximum optical density (Dmax) of 0.14 and was fused for 10 sec at 90° C. with heated air.

The element bearing the fused first toner deposit was recharged overall in the dark to a background (nonimage region) charge density of 180 nanocoulombs/cm$^2$ (+600 volts). (The charge was applied in a uniform manner to all regions of the photoconductor surface. Because of charge-injection from the first toner deposit into the photoconductor layer, however, the charge density was stable only in the background region of the recharged surface.

The recharged film was maintained in darkness for 16 sec so that the charge density in Dmax regions of the first-stage image decreased to 75 nanocoulombs/cm$^2$ (+250 volts). Thus, a second charge pattern was formed having a charge differential per unit area of 105 nanocoulombs/cm$^2$. When redeveloped in the dark with the same developer, at a development electrode bias of +520 to +540 volts, a second toner deposit having a maximum optical density, Dmax, of 0.95 to 1.3 was obtained corresponding to the Dmax of the first toner deposit.

Control

The procedure was repeated, eliminating the second charging and developing on an identical control element. The imagewise exposure was increased to 190 relative units to produce a charge differential of 90 nanocoulombs/cm$^2$ (a decay from +600 volts to +300 volts). The differential charge was developed and fused to produce an image having a Dmax of 1.3.

The neg-pos amplification achieved for 0.1 optical density (OD) unit above background as a result of the foregoing process was determined to be 20, meaning an image of 0.1 above background was achieved with approximately 20 times less imagewise light necessary to produce the same image density in an imagewise exposure and single development step employed in processing the control element.

Furthermore, the CDA amplification achieved using maximum OD (Dmax) as the speedpoint was determined to be 10, meaning that an image at Dmax was achieved with 10 times less imagewise light exposure employed to produce the same image density in the control.

The image contrast for the CDA process was less than that for the control process. By comparison, however, contrasts achieved in prior-art amplification processes in which electrostatic charge differentials are enhanced by light exposure through a toner mask to produce photodischarge in nontoned regions are higher than the control process.

EXAMPLE 2

This illustrates amplification by charge injection using a developer with a higher developer sensitivity.

Example 1 is repeated except the developer sensitivity is increased to 27 OD cm$^2$/$\mu$C. The neg-pos amplification for this example is 32.

EXAMPLE 3

This illustrates amplification by charge injection in a positive-positive image-sense mode of development.

An element as in Example 1 was charged to 180 nanocoulombs/cm$^2$ (−600 volts) and imagewise-exposed as in Example 1. The resulting charge image was developed as before with a development electrode bias of −570 volts to produce a low density, first toner deposit in unexposed regions having a Dmax of 0.12–0.14.

The element bearing the first toner deposit was fused, recharged positively, redeveloped and refused as in Example 1 to produce a second toner deposit having a Dmax of from 0.8 to 1.2 and a pos-pos amplification ranging from 7 to 16.

EXAMPLES 4–6

This illustrates amplification by charge injection using different photoconductive elements.

The developer of Example 1 was employed to develop various photoconductors. The results for each photoconductor are shown in Table 1.

TABLE 1

| Example | Photo-conductor | Charge Density Applied (Nanocou-lombs/cm²) | Initial Voltage (Vo) | Charge Differen-tial after Exposure (Nanocou-lombs/cm²) | Dmax after First Devel-opment | Second-Stage Charge Density (Nontoned Regions, in Nanocou-lombs/cm²) | Enhanced Charge Differ-ential (Nanocou-lombs/cm²) | Dmax after Second Devel-opment | Amplifi-cation |
|---|---|---|---|---|---|---|---|---|---|
| 4 | aggregate[1] | 210 | +600 | 10.5 | 0.14 | 210 | 84 | 1.3 | 19 (neg-pos) |
| 5 | polymeric[2] | 180 | +600 | ≈12 | 0.19 | 180 | 57 | 0.80 | >10 (neg-pos) |
| 6 | polymeric[2] | 180 | −600 | ≈9 | 0.12 | 180 | 57 | 0.72 | >5 (pos—pos) |

[1]Comparable to the aggregate-containing elements described in any of the examples of U.S. Pat. No. 3,679,408
[2]As in U.S. Pat. No. 3,615,418, Example 3, Element C, except the dye concentration was 2% instead of 3%, and the monomeric photoconductor was replaced by the polymeric photoconductor poly[tetramethylene-co-1,4-cyclohexanedimethylene-N,N—bis(4-hydrocinnamate)aniline]

EXAMPLE 7

This illustrates a xeroprinting process wherein a first toner deposit formed in the manner set forth above is amplified repeatedly to form multiple copies.

Example 1 was repeated through the fused first toner deposit-formation steps using Kodak Ektavolt Recording Film, Type SO-102 (a trademark of Eastman Kodak Company). The first-stage charge density was 217 nanocoulombs/cm² (+620 volts); 19 relative exposure units were employed, the development electrode bias was set at +590 volts and the first toner deposit fused at 90° C. for 10 sec.

In the second stage, the element and first toner deposit were recharged to 210 nanocoulombs/cm² (+600 volts), maintained charged for 16 sec and redeveloped at a bias voltage of +520 volts to a second toner deposit having a Dmax of 1.0 to 1.1. Before fusing, the second toner deposit was electrostatically transferred to a barium sulfate-coated insulating paper element at a transfer voltage of about +600 to +700 volts. The transferred deposit was fused to the paper element.

The second stage was repeated 10 times to produce a succession of copies. The neg-pos amplification associated with each copy was 10. Dmax on paper element was 1.4.

EXAMPLE 8

This illustrates amplification as in Example 1, except that the current-carrying path between the first toner deposit and the photoconductor element electrode layer was formed by pressure-fixing the first toner deposit on the photoconductor layer. The toner was pressure-fixed with a cold pressure roller at 14.3 Kg/cm.

The neg-pos amplification was 7.

EXAMPLE 9

This illustrates amplification by charge injection using a palladium- and carbon-containing toner as the first toner deposit.

An element as in Example 1 was charged to 60 nanocoulombs/cm² (+200 volts) and exposed so as to create a first charge differential per unit area of 7.5 nanocoulombs/cm² (a voltage differential of 25 volts). The resulting first charge pattern was developed with a developer as in Example 1 except that the toner formulation contained a palladium (Pd) catalyst adsorbed onto the carbon black pigment at 10% of Pd metal catalyst, by weight, based on the carbon black pigment. The image was fused at 90° C. for 10 sec.

In the second stage, the first toner deposit and element was recharged in the dark to 180 nanocoulombs/cm² (+600 volts). After 3 sec, the charge in image regions decayed to 75 nanocoulombs/cm² (+250 volts). The resulting charge pattern was redeveloped at a bias voltage of +500 volts with the carbon-containing developer of Example 1 to give an image having a Dmax of 0.95–1.3 and a neg-pos amplification of 20.

EXAMPLE 10

This illustrates a comparison between a first toner deposit which formed the requisite charge-carrying path and a toner deposit which did not form such path under otherwise equivalent processing conditions.

The two developers employed in this example were the same as the developer in Example 1, except: the first contained magenta pigment to color the toner instead of carbon black; the second developer also contained magenta pigment in place of carbon black, but also contained no ammonium salt copolymer.

A first toner deposit was formed on respective elements as in Example 1 using the first and second developers above. The imagewise exposure was conducted with red light to simulate a red separation. All other process conditions set forth in Example 1 were employed except the bias voltage was +550 volts.

The first toner deposit on each element was recharged in the dark to 180 nanocoulombs/cm² (+600 volts). The voltage decay in the toner-deposit region of each element was observed when 16 sec had elapsed. The results are shown in Table 2.

TABLE 2

| Toner | (a) Voltage After 16 Sec | Voltage Decay [600-(a)] |
|---|---|---|
| with quaternary ammonium salt copolymer | 350 | 250 |
| without quaternary ammonium salt copolymer | 580 | 20 |

These results indicate that the second toner listed in Table 2 could not be used in the first stage of the present invention because little or no charge differential per unit area could be obtained upon recharging.

EXAMPLE 11

This illustrates amplification by charge injection using a dry, two-component developer composition applied by a magnetic brush. The toner in this composition had an average particle size of 9 micrometers and comprised 5% (by weight) dye, 20% carbon black, 14% of the quaternary ammonium salt charge-control agent poly[t-butyl styrene-co-beta(methacryloxy)ethyl trimethyl ammonium p-toleuensulfonate] and 7% of the binder resin Piccotex 120 TM (available from Pennsylvania Industrial Chemicals Co.).

Example 1 was repeated using Kodak Ektavolt Recording Film, Type SO-102 and the above dry developer to produce a first toner deposit having a Dmax of 0.4 and a second toner deposit having a Dmax of 1.41. The amplification was >5.

EXAMPLE 14

This illustrates our CDA process, using various dielectric recording-film elements.

The charge-holding layers in the elements employed compositions comprising various organic photoconductors dispersed in Lexan 145 TM resin (a trademark of General Electric Co. for a bisphenol polycarbonate resin) in a photoconductor concentration of 35% by weight of photoconductor plus resin. (In these charge-holding layers, the photoconductor was employed to make the layer capable of transporting charge injected therein from the first toner deposit. The layers were otherwise not photosensitive in the visible spectrum or, if photosensitive, were not exposed to actinic radiation to form the first electrostatic charge pattern.

The binder and photoconductor were dissolved in enough 1,2-dichloromethane to produce a 12% solids solution. The resultant dopes were coated onto nickelized polyester film on a heated coating block at 15° C. using a 75-micrometer coating knife. The film coatings were then cured in a drying oven for 1 hr at 60° C. The formulation for Photoconductor Film E was prepared at 5% solids and no Lexan 145 TM was present because the polymeric photoconductor formed its own matrix.

Low-density (0.12–0.14 O.D.) toner patches were electrophoretically plated out onto each photoconductor film surface using developer similar to the developer in Example 1 and low charge differentials per unit area. The samples of Kodak Ektavolt Recording Film Type SO-102 (a trademark of Eastman Kodak Company) were also tested in a no-exposure mode by simply plating (see Photoconductor Film F, Table 2) and by our CDA process, i.e., toner-plating with subsequent recharging on another sample (see Photoconductor Film G, Table 2). Toner patches were fused at various temperatures and recharged to +600 volts. The charge-injection property was derived by measuring the voltage drop in a toned region and by calculating the maximum charge differential per unit area available for redevelopment. These values are reported in Table 2 below for each photoconductor film tested.

For the films tested, the charge gain or amplification factor at Dmax due to CDA ranged from 16 to >20X higher than comparative Example F, Kodak Ektavolt Recording Film, Type SO-102 (a trademark of Eastman Kodak Company), with no recharging. (Amplification in this instance is determined by dividing the second-stage charge available for redevelopment by the first-stage charge deposition.)

TABLE 3

| | Photoconductor Film | Maximum Charge Deposited by Electrophoretically Plated Toner (nanocoulombs/cm$^2$) | Maximum Charge Differential per Unit Area Available for Redevelopment (nanocoulombs/cm$^2$) | Charge Gain or Amplification Factor |
|---|---|---|---|---|
| (A) | tri-p-tolylamine | 6 | 124 | 20 |
| (B) | 1,1-bis(4-di-p-tolylaminophenyl)cyclohexane | 6 | 132 | 20 |
| (C) | triphenylamine | 6 | 127 | 20 |
| (D) | tri-4-anisylamine | 6 | 120 | 20 |
| (E) | polyvinylcarbazole | 6 | 108 | 16 |
| (F) | Kodak Ektavolt Recording Film Type SO-102 electrophoretic plating process (no recharging) (comparative example) | 6 | — | 1* |
| (G) | Film sample as in (F) above; CDA process (with recharging) | 6 | 100 | 16 |

*Charge gain with respect to first charge deposited by toner was assigned a gain = 1. Dmax of the toner patches on all film samples tested was between 0.12–0.14 OD.

EXAMPLE 13

This example shows a combination of photoconductor film and first toner deposit in which the toner injects either positive or negative charges into the photoconductor via a current-carrying path.

In this example, the toner and process conditions were similar to those described in Example 1. The film was an aggregate film prepared as described in U.S. Pat. No. 3,679,408, Example 1, except that the thiapyrylium dye contained a hexafluorophosphate anion in place of the fluoroborate anion. Dmax after first development was 0.12. The film was then processed as two samples.

One film sample was recharged to +600 volts and the second sample was recharged to −600 volts. The voltage drop (ΔV) in the toned region was 190 volts for the positively recharged film and 160 volts for the negatively recharged film. For both polarities, the voltage drops (ΔV's) or second charge differentials per unit area would be sufficient to provide a high Dmax after redevelopment.

EXAMPLE 14

This example shows high amplification using a second-stage developer having a different toner sensitivity from the first-stage developer. The image-sense mode was negative-positive.

The photoconductive element in this example was prepared as described in U.S. Pat. No. 4,350,751, Example 1, at a photoconductor-layer thickness of 3.8 micrometers.

The photoconductive layer of this element was uniformly charged to an initial charge density of 140 nanocoulombs/cm$^2$ (+200 volts). The charged layer was imagewise exposed to light to lower the charge density in light-struck regions by 7 nanocoulombs/cm$^2$ (ΔV=10 volts).

The resulting first electrostatic charge pattern was developed in the dark for 3 sec at a development electrode bias of +200 volts with developer similar to the developer in Example 1 having a toner sensitivity of 12 OD $cm^2/\mu C$.

The first toner deposit was fused for 15 sec at 120° C. with heated air.

The element bearing the fused first toner deposit was recharged overall in the dark to a charge density of 315 nanocoulombs/$cm^2$ (+450 volts). The recharged film was maintained in darkness, during which time the charge density in Dmax regions of the first image decreased to 105 nanocoulombs/$cm^2$ (+150 volts) and the charge density in nontoned regions decreased to 186 nanocoulombs/$cm^2$ (+266 volts). (Charge decrease in nontoned regions was due to dark decay.) The resulting charge differential per unit area, therefore, was 210 nanocoulombs/$cm^2$ ($\Delta V = +116$ volts). When redeveloped in the dark with a similar developer having a higher toner sensitivity of 27 OD $cm^2/\mu C$, at a development electrode bias of $\sim +266$ volts, a second toner deposit having a Dmax of 1.5 and a Dmin of 0.00 was obtained.

The neg-pos amplification achieved was 25.

Although the invention has been described in considerable detail with particular reference to certain preferred embodiments thereof, variations and modifications can be effected within the spirit and scope of the invention.

We claim:

1. A method of amplifying an electrostatic charge differential pattern comprising:
   (a) imagewise forming a first toner deposit by developing a first electrostatic charge pattern having a first charge differential per unit area whose maximum value is no greater than a preselected level,
   (b) in an image-amplification element comprising a charge-holding surface layer overlying a field-supporting electrode, forming a current-carrying path between said first toner deposit and said field-supporting electrode,
   (c) under conditions in which nontoned regions of said charge-holding layer are not photoexcited, overall charging said image-amplification element with sufficient charge to form an enhanced electrostatic charge pattern having a second charge differential per unit area whose maximum value is greater than said preselected value, and
   (d) developing said second charge pattern into a second toner deposit.

2. The method of claim 1 wherein said preselected charge differential per unit area is 30 nanocoulombs/$cm^2$.

3. The method of claim 2 wherein the maximum value of said second charge differential per unit area is at least 60 nanocoulombs/$cm^2$.

4. The method of claim 2 wherein the maximum value of said first charge differential per unit area is from about 5 to about 15 nanocoulombs/$cm^2$ and the maximum value of said second charge differential per unit area is from about 100 to about 150 nanocoulombs/$cm^2$.

5. A method of amplifying an electrostatic charge differential pattern comprising:
   (a) in an image-amplification element comprising a charge-holding surface layer overlying a field-supporting electrode, imagewise forming a first toner deposit by developing a first electrostatic charge pattern having a first charge differential per unit area whose maximum value is no greater than a preselected level,
   (b) forming in said image-amplification element a current-carrying path between said first toner deposit and said field-supporting electrode,
   (c) under conditions in which nontoned regions of said charge-holding layer are not photoexcited, overall charging said image-amplification element with sufficient charge to form an enhanced electrostatic charge pattern having a second charge differential per unit area whose maximum value is greater than said preselected value, and
   (d) developing said second charge pattern into a second toner deposit.

6. The method of claim 5 wherein said charge-holding layer of said image-amplification element is photoconductive and said first electrostatic charge pattern is electrophotographically formed and developed on said charge-holding layer.

7. The method of claim 6 wherein said first toner deposit comprises a pigment dispersed in a polymeric matrix.

8. The method of claim 7 wherein said pigment is a conductive pigment.

9. The method of claim 7 wherein said pigment is carbon black.

10. The method of claims 6, 8 or 9 wherein said current-carrying path is formed by heat-fixing said first toner deposit to said charge-holding layer.

11. The method of claim 5 wherein said preselected charge differential per unit area is 30 nanocoulombs/$cm^2$.

12. The method of claim 11 wherein the maximum value of said second charge differential per unit area is at least 60 nanocoulombs/$cm^2$.

13. The method of claim 11 wherein the maximum value of said first charge differential per unit area is from about 5 to about 10 nanocoulombs/$cm^2$ and the maximum value of said second charge differential per unit area is from about 100 to about 150 nanocoulombs/$cm^2$.

* * * * *